US005345209A

United States Patent [19]

Saitoh et al.

[11] Patent Number: 5,345,209

[45] Date of Patent: Sep. 6, 1994

[54] ADJUSTMENT SYSTEM FOR A COIL DEVICE

[75] Inventors: Yutaka Saitoh; Shinichiro Ito; Yukiharu Kinoshita, all of Tokyo, Japan

[73] Assignee: TDK Corporation, Tokyo, Japan

[21] Appl. No.: 922,693

[22] Filed: Jul. 30, 1992

[51] Int. Cl.[5] ..... H01F 21/02; H01F 27/26

[52] U.S. Cl. ..... 336/83; 336/134; 336/178; 336/212

[58] Field of Search ..... 264/272.15, 275, 277, 264/278; 336/212, 83, 178, 134, 136

[56] References Cited

U.S. PATENT DOCUMENTS

| | | | |
|---|---|---|---|
| 2,130,815 | 9/1938 | Riepka | 336/83 |
| 2,174,355 | 9/1939 | Sundstrom | 336/83 |
| 2,413,201 | 12/1946 | Tillman | 336/83 |
| 2,457,806 | 1/1949 | Crippa | 336/83 |
| 2,494,579 | 1/1950 | Pimlott et al. | 336/83 |
| 2,801,293 | 7/1957 | Howell et al. | 336/83 |
| 2,946,029 | 7/1960 | Abrams et al. | 336/136 |
| 3,078,429 | 2/1963 | Wiesner | 336/83 |
| 3,197,167 | 7/1965 | Sturgis | 336/83 |
| 3,209,294 | 9/1965 | Cornell | 336/83 |
| 3,259,861 | 7/1966 | Walker | 336/136 |
| 3,471,815 | 10/1969 | Grant et al. | 336/136 |
| 3,480,896 | 11/1969 | Neuman | 336/83 |
| 3,750,069 | 7/1973 | Renskers | 336/83 |
| 4,377,548 | 3/1983 | Pierpont | 264/278 X |
| 4,558,295 | 12/1985 | Olmsted et al. | 336/83 |
| 4,866,409 | 9/1989 | Umezaki | 336/178 |

FOREIGN PATENT DOCUMENTS

| | | | |
|---|---|---|---|
| 658259 | 4/1938 | Fed. Rep. of Germany | 336/83 |
| 43451 | 6/1934 | France | 336/83 |
| 62741 | 5/1976 | Japan . | |
| 75545 | 6/1976 | Japan . | |
| 50372 | 12/1980 | Japan . | |
| 24363 | 6/1981 | Japan . | |
| 58-33810 | 2/1983 | Japan | 336/83 |
| 59-217311 | 12/1984 | Japan | 336/178 |
| 879940 | 10/1961 | United Kingdom | 336/83 |
| 887204 | 1/1962 | United Kingdom | 336/83 |
| 1054341 | 1/1967 | United Kingdom | 336/83 |

*Primary Examiner*—Thomas J. Kozma

*Attorney, Agent, or Firm*—Knobbe, Martens, Olson & Bear

[57] ABSTRACT

The present invention is comprised of an outside magnetic substance forming an endless loop, an inside magnetic substance formed inside of said outside magnetic substance and coil wound on the periphery of said inside magnetic substance. In a coil device of the present invention with gaps between both ends of said outside magnetic substance and said inside magnetic substance, notches or holes are provided in said outside magnetic substance for the purpose of inserting insert a jig therein so as to adjustably move the position of said inside magnetic substance, wherein said notches or holes correspond to the gaps provided in both ends of said inside magnetic substance. In said coil device, the inside magnetic substance can be adjusted and moved its position by pressing a bar-like jig through the notches or the holes provided in the outside magnetic substance. Thus, it has become possible to adjust the value of the inductance by about 25% experimentally.

6 Claims, 5 Drawing Sheets

ADJUSTMENT SYSTEM FOR A COIL DEVICE

FIELD OF THE INVENTION

This invention relates to a coil device having a ferrite core utilized in various types of coil devices such as a transformer or a choke coil.

BACKGROUND OF THE INVENTION

Conventionally, a magnetic core having a gap used for the transformer and the choke coil, has been utilized as follows: an opposed pair of E-shaped cores made from magnetic materials such as ferrite, which is disclosed in Japanese Patent Publication No. 50372/1980, wherein gaps are provided in the end of a center leg so as to prevent magnetic saturation, or a combination of E-shaped and I-shaped core which is disclosed in Japanese Patent Publication No. 24363/1981, wherein the similar gaps as described above are provided in the end of the center leg of the E-shaped core.

However, such conventional magnetic cores having gaps, used in a choke coil or a transformer having a wire wound on the center leg often cause errors in inductance, which is most often derived from errors in the dimension of the magnetic core, errors during the production of the gaps and errors in magnetic permeability of the core. For example, when an effective permeability is 100, the variation of the inductance of the choke coil is ±21% in E—E type (disclosed in Japanese Patent Publication 50372/1980), and is ±16% in E-I type (disclosed in Japanese Patent Publication 24363/1981).

SUMMARY OF THE INVENTION

In view of the foregoing facts, an objective of the present invention is to provide a coil device whereby it is possible to adjust the variation of the inductance.

In order to accomplish the above objective, the coil device of the present invention comprises: an outside magnetic substance forming an endless loop, an inside magnetic substance formed inside of the outside magnetic substance, and the coil wound on the periphery of the inside magnetic substance. In a coil device comprised as above and having gaps between said outside magnetic substance and said inside magnetic substance, the coil device is characterized in that it provides notches or holes in the outside magnetic substance where said notches or holes correspond to both end surfaces of the inside magnetic substance, wherein a jig can be inserted through said notches or holes so as to adjustably move the position of the inside magnetic substance. Said notches are U-shaped or triangle-shaped, and said holes are through holes such as round or square in shape.

In the coil device of the present invention structured as in the foregoing, the position of the inside magnetic substance can be adjustably moved by inserting and pressing a bar-like jig through the notches or holes provided in the outside magnetic substance. Thus, it has become possible to adjust the value of the inductance about 25% experimentally.

Therefore, even with the positioning errors obtained while assembling the choke coils or the transformers, the dimensional errors of the magnetic core, or the errors caused during the process of forming the gaps, the present invention provides highly accurate inductance values and to provide the choke coils or the transformer having less variation in inductance by performing said adjustment in the final test process.

BRIEF DESCRIPTION OF THE DRAWINGS

FIG. 1 is a plan view of a combination of a □-shaped outside magnetic substance, I-shaped inside magnetic substance and a coil.

FIG. 2 is a plan view showing a H-shaped (or drum type) inside magnetic substance.

FIG. 3 is a plan view showing a hexagon-shaped outside magnetic substance.

FIG. 4 is a plan view showing a toroidal-shaped outside magnetic substance.

FIG. 5 is a side view of the outside magnetic substance described in FIGS. 1–4.

FIG. 6 is a side view of the outside magnetic substance having a hole.

FIGS. 7 and 8 are plan views of the coil device which utilizes bobbins.

FIG. 9 is a variable diagram showing the value of the inductance when the inside magnetic substance is moved against the outside magnetic substance and the coil or the outside magnetic substance is moved against the inside magnetic substance and the coil.

FIG. 10 is a perspective view of an example of coil devices in accordance with the present invention.

DESCRIPTION OF THE PREFERRED EMBODIMENTS

In the following, the preferred embodiments of the present invention are described in detail.

Figure 1:
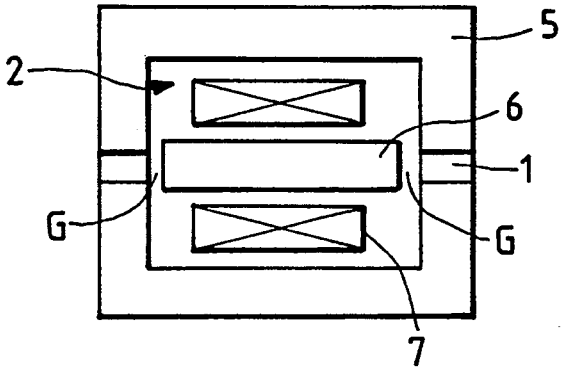
FIGS. 1–8, and 10 are embodiments of the present invention.

The coil device in FIG. 1 is comprised of the □-shaped outside magnetic substance 5 which forms an endless loop and a coil device 2 having a coil 7 wound on a bar-like inside magnetic substance 6 which is provided inside of the outside magnetic substance 5. There are two predetermined gaps G provided between both ends of the inside magnetic substance 6 and the outside magnetic substance 5. On the surface of the outside magnetic substance 5, notches 1 are formed for insertion of the jig, wherein these notches are adapted to correspond to the two gaps G provided in the both ends of the inside magnetic substance 6. Each of said magnetic substances 5 and 6 are made from the ferrite magnetic core material. The outside magnetic substance 5 is a square tube in shape, and the shape of the inside magnetic substance 6 is either a round bar, plate-like or a rectangular parallelepiped.

Figure 2:
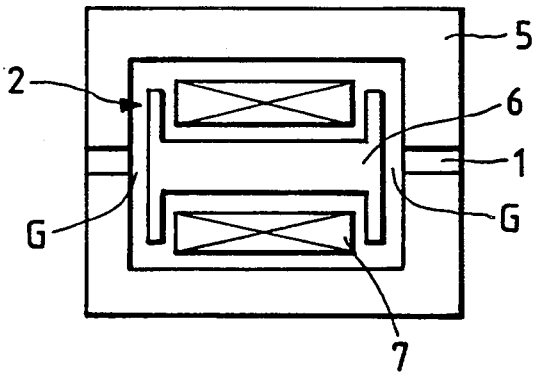

FIG. 2 shows a coil device 2, wherein the coil 7 is wound on the H-shaped inside magnetic substance 6 which is provided inside of the □-shaped outside magnetic substance 5.

Figure 3:
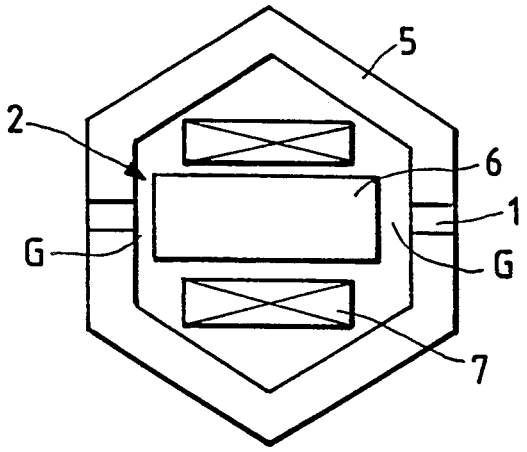
Figure 4:
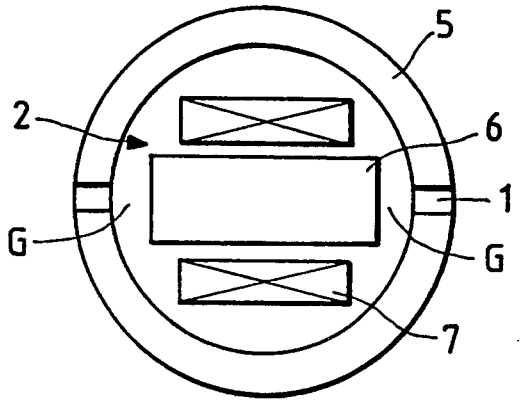

Reference numeral G shows the gaps as described in the foregoing. H-shaped inside magnetic substance 6 is comprised of a drum-shaped or a square-shaped core. FIG. 3 shows a hexagon-shaped outside magnetic substance 5. FIG. 4 shows one utilizing a toroidal-shaped core as the outside magnetic substance 5.

The embodiments shown in FIGS. 1–4 are structured so as to adjust the gaps G by inserting and pressing the jig through the notches 1. Since the gaps G are very small, for example, less than 1 mm, in this kind of coil devices, it is usually not feasible to insert the jig directly into the gaps. Thus, it is necessary to press the inside magnetic substance in a horizontal direction by a rod like jig through the notches 1.

Figure 10:
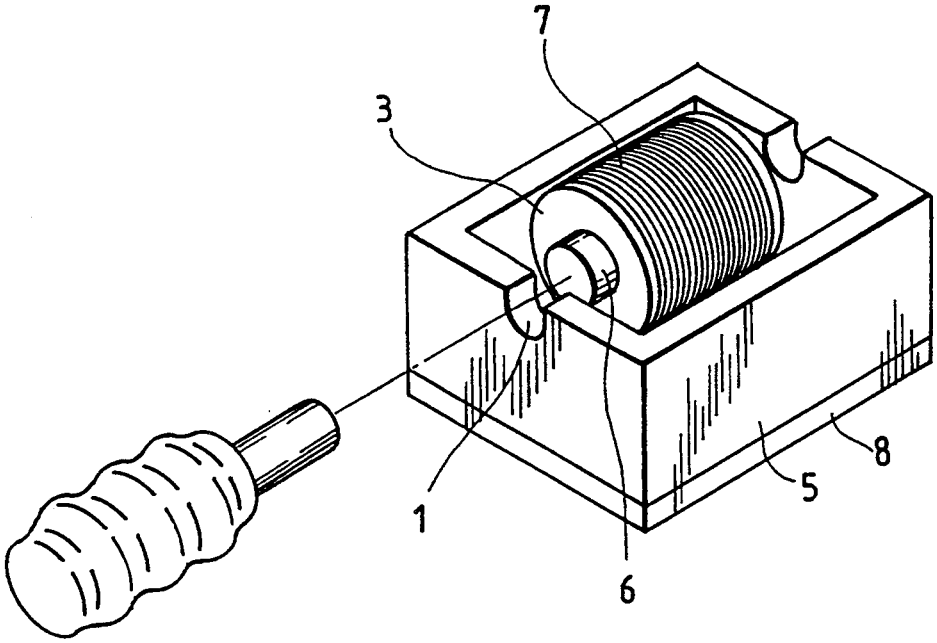
Figure 7:
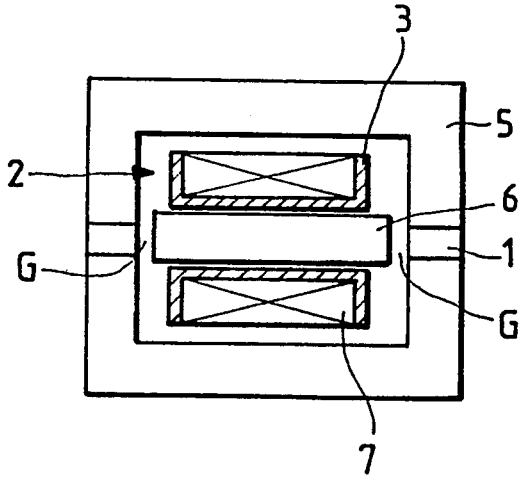
Figure 8:
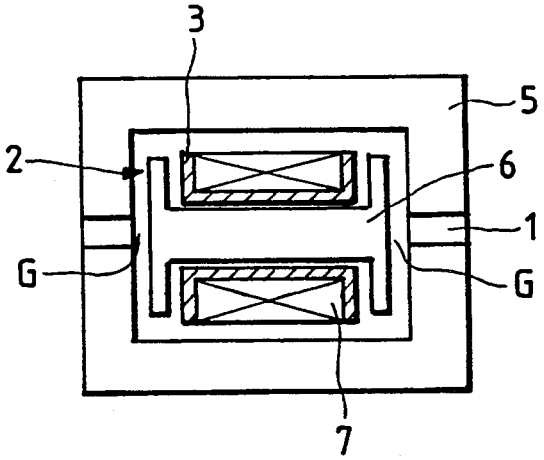

An example of overall shape of the coil devices in accordance with the present invention is illustrated in a perspective view of FIG. 10. In FIG. 10, the outside magnetic substance 5 and the inside magnetic substance 6 are mounted on a base 8. The coil 7 is wound aroused a bobbin 3 which is mounted on the inside magnetic substance 6. A set comprising the coil 7, the bobbin 3 and the inside magnetic substance 6 is provided with, for example, adhesive resin to be molded with respect to the base 8 after adjustment of the inductance value through exposure to heat or ultraviolet light. In this configuration, the gaps G will be adjusted by inserting the jig through the notch 1 and pressing the inside magnetic substance 6 as shown in FIG. 10. After the adjustment, the position of the inside magnetic substance with respect to the outside magnetic substance is fixed by hardening the adhesive resin as described above.

Figure 5:
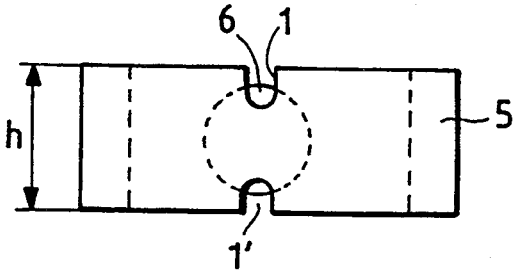

The notches 1 shown in the embodiments are U-shaped notches as shown in FIG. 5. The depth of the notches is designed so that a part of the inside magnetic substance 6 is visible from the outside. As shown in FIG. 5, if the notches 1 and 1' are provided in both the upper and the lower directions of a height h, the adjustment of the gaps G becomes much easier. The notches 1 and 1' can be shaped as an inverted triangle, a semicircle or a half square.

Figure 6:
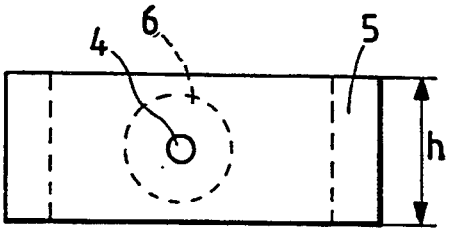

Furthermore, instead of having the notches 1 and 1', a hole 4 in the center of the outside magnetic substance 5, as shown in FIG. 6, can be provided so that the jig can be inserted therein. Also, the shape of the hole can be a triangle or a polygon.

Figure 7:
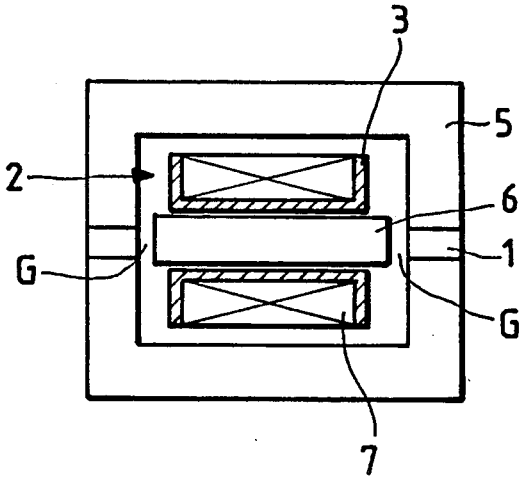
Figure 8:
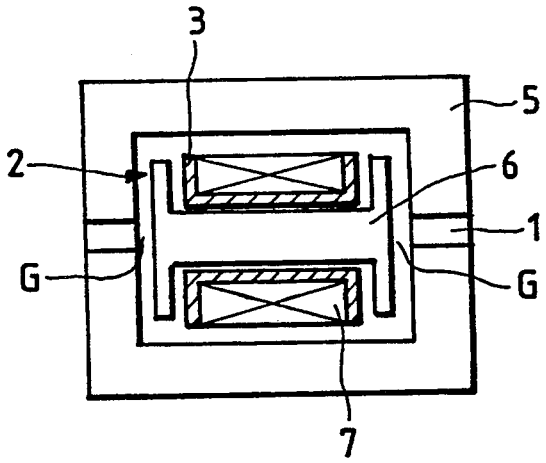

The foregoing embodiments show the structure of the inside magnetic substance 6 in which the coil 7 is directly wound. However, as shown in FIGS. 7 and 8, it is also possible to have a structure whereby the coil 7 is wound through bobbins 3. The bobbins have flanges in both ends and are assembled in order to change the relative position of the coil with respect to the inside magnetic substance 6. Therefore, by employing these embodiments, it is possible not only to change the relative position (the gaps G) between the inside magnetic substance 6 and the outside magnetic substance 5 with insertion of the jig into the notches 1, but also to change the relative position between the inside magnetic substance 6 and the coil 7 by pressing the flanges of the bobbins 3. It is also possible to provide the features to the embodiments shown in FIGS. 3 and 4 by employing the bobbins 3.

Furthermore, when providing the hole shown in FIG. 6 instead of the notches 1, wherein multiple holes are provided in the upper and the lower sides, one of the holes can be used for moving the inside magnetic substance 6, and the other one can be used for moving the bobbin in which the coil is wound. With this method, each of the inside magnetic substance and the bobbins can be moved and adjusted freely.

FIG. 9 is a diagram showing the test result of the adjustment of the inductance when using the coil device of the present invention. The cross axis of the diagram shows the distance between the outside magnetic substance and the inside magnetic substance in millimeters (mm), and the transverse axis shows the inductance. A curve A shows a case when only the inside magnetic substance is moved, and a curve B shows a case when both the outside magnetic substance is moved against the inside magnetic substance and the coil.

As a result, it has been confirmed that the curve A has a variable range of 29.2%, and the curve B has that of 38.4%. In short, both of the curves A and B have the large variable ranges, especially the curve B, with when compared to conventional inventions, and it means that even large errors can be precisely adjusted.

With the above described coil device, after the inside magnetic substance 6 having the coil 7 wound therein is placed into the outside magnetic substance 5 and the value of the inductance is measured, and if the errors (the errors in measurement against the expected values) are found, it is possible to adjust the errors by moving the position of the inside magnetic substance 6 with insertion of the jig into the hole 4 (that is, the gaps G are adjusted therein). Or if a bobbin is utilized, it is also possible to adjust the errors not only by moving the inside magnetic substance 6, but also by pressing the bobbin 3 so as to change the position between the coil 7 and the inside magnetic substance 6. Therefore, it is possible to obtain products having smaller variations in inductance even when a large number of coil devices are produced.

What is claimed is:

1. An adjustment system for a coil device, comprising:

an outside magnetic substance;

an inside magnetic substance arranged within said outside magnetic substance so as to form gaps between said inside magnetic substance and said outside magnetic substance;

a bobbin mounted on said inside magnetic substance, said bobbin having flanges;

a coil mounted on said bobbin;

first and second openings in said outside magnetic substance, said openings being aligned with said gaps;

third and fourth openings in said outside magnetic substance, said third and fourth openings being adjacent to said first and second openings and being aligned with said flanges of said bobbin; and an elongate adjustment tool having a cross section sufficient to permit it to pass through either of said first and second openings in order to make contact with said inside magnetic substance in order to adjust the size of said gaps, and permitting it to pass through either of said third and fourth openings in order to make contact with said bobbin, whereby the position of said bobbin may be adjusted to adjust the inductance of said coil device.

2. An adjustment system for a coil device as defined in claim 1, wherein said outside magnetic substance is configured as a square-shaped ring.

3. An adjustment system for a coil device as defined in claim 1, wherein said inside magnetic substance is configured as a cylindrical bar.

4. An adjustment system for a coil device as defined in claim 1, wherein said outside magnetic substance has a toroidal shape.

5. An adjustment system for a coil device as defined in claim 1, wherein said inside magnetic substance is configured as a bar with a cross-section of a square.

6. An adjustment system for a coil device as defined in claim 1, wherein said inside magnetic substance is configured as an H-shaped bar.

* * * * *